United States Patent [19]

Fors

[11] Patent Number: 4,566,598

[45] Date of Patent: Jan. 28, 1986

[54] ARRANGEMENT IN DISPLAY AND STORAGE RACKS

[75] Inventor: Henry Fors, Sundbyberg, Sweden

[73] Assignee: Forss Union AB, Sweden

[21] Appl. No.: 526,650

[22] Filed: Aug. 26, 1983

[30] Foreign Application Priority Data

Aug. 27, 1982 [SE] Sweden ..... 8204913

[51] Int. Cl.[4] ..... A47F 5/08

[52] U.S. Cl. ..... 211/96; 211/4; 211/169

[58] Field of Search ..... 211/4, 169, 96, 40

[56] References Cited

U.S. PATENT DOCUMENTS 3,805,962 4/1974 Bendiksen ..... 211/4
3,915,306 10/1975 Desisto et al. ..... 211/4
4,102,458 7/1978 Fors ..... 211/4

FOREIGN PATENT DOCUMENTS 2335965 1/1975 Fed. Rep. of Germany ..... 211/4

*Primary Examiner*—Robert W. Gibson, Jr.
*Attorney, Agent, or Firm*—Ostrolenk, Faber, Gerb & Soffen

[57] ABSTRACT

The invention relates to an arrangement in display and storage racks with swingable frames particularly for easily stolen and difficultly displayed articles (A), including at least one shelf space, having means (19–22) for preventing unauthorized removal of the articles (A) from the rack. The means (19–22) comprise projections or flanges projecting from the upper and lower portions of the shelf space and over the edge portions of the article (A), at least one of said projections (22) being movable vertically such that an article (A) is removable from the shelf space after the flange (22) has first been displaced to a position outside the edge portion of the article (A).

6 Claims, 7 Drawing Figures

Figure 1:
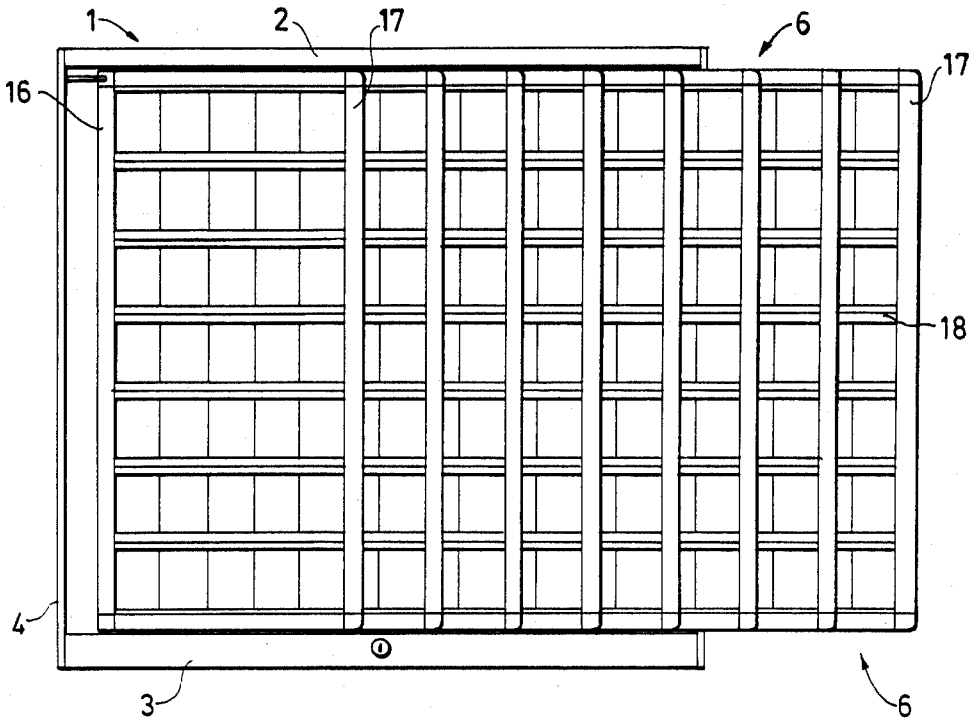

2
7
8
25
5
14
26
24
16
6
24
15
28
27
29
9
37
3
12
11
13
10

ARRANGEMENT IN DISPLAY AND STORAGE RACKS

The present invention relates to an arrangement in display and storage racks with swingable frames, particularly suitable for easily stolen and difficultly displayed goods, e.g. music and video cassettes, clocks, cigarette lighters etc., and encludes at least one shelf space with a depth, height and lateral dimensions adapted to the depth, height and width dimensions of the articles in question, and which is defined laterally by two side members and vertically by a top member, said members having means for preventing removal of the goods from the shelf space.

Sales and display racks are known in many different embodiments. Attempts have been made for a long time to find a solution to the problem of how to display articles, which are expensive in spite of their small size, in a pleasing manner while simultaneously preventing their unauthorized removal. Structures in the prior art are complicated in use and have deficiencies in both ease of handling and function. The object of the present invention is therefore to provide a rack having swingable frames which meets very high demands from the aspects of display function and handling. Essentially distinguishing for the invention is that the frames have means for preventing removal of the articles from the shelf space, comprising projections from the opposing surfaces of the top and bottom members extending in the area of the top and bottom portions of the articles, and along the front and rear sides thereof, at least one of said projections being movable vertically from a position in which a portion or the whole of its length engages against the front or rear side of the articles, preventing their removal from the shelf space, and to a position in which substantially the whole of its length is away from the vertical extension of them, such that the articles placed in the shelf space are removable therefrom by tipping out their top or bottom portions.

As a result of the invention there is now obtained a display and storage rack serving its purpose excellently, but being simple and cheap to manufacture at the same time. The display and storage rack with its frames functions according to the self-selection principle by the customer selecting the desired article and obtaining service only for unlocking and taking out the article from the appropriate shelf space in a frame. By the rack having the frames disposed in a wall mounting or the like, with the frames being able to be swung through an angle of about 135°, the articles in the shelf spaces are displayable on both sides. The frames are locked with a lock placed in the lower rail of the wall mounting, but can be "leafed through" in the locked position as well. When the customer has chosen a desired product, the rack is unlocked, enabling all the leafing frames to be opened separately with the aid of a handwheel at the lower outer edge of the frames. The design of the frames enables them to be both right- or left-hand hung, which means that the goods can be completely exposed independent of how the rack is placed. The frames are furthermore provided with a spring means, the function of which is to return the frames to their initial position after the customer has leafed through them.

The invention will now be described with the aid of an embodiment selected as an example and depicted on the appended drawings.

Figure 4:
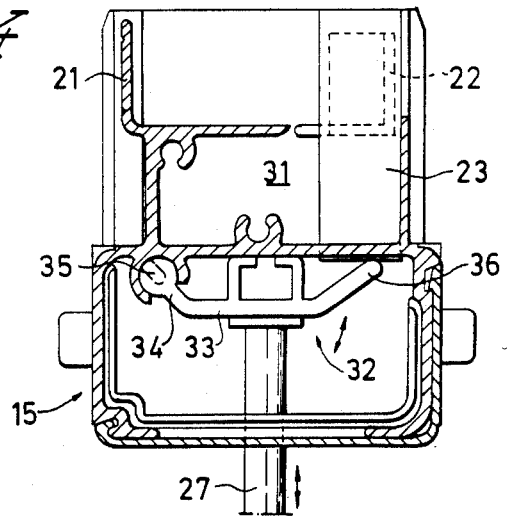
Figure 2:
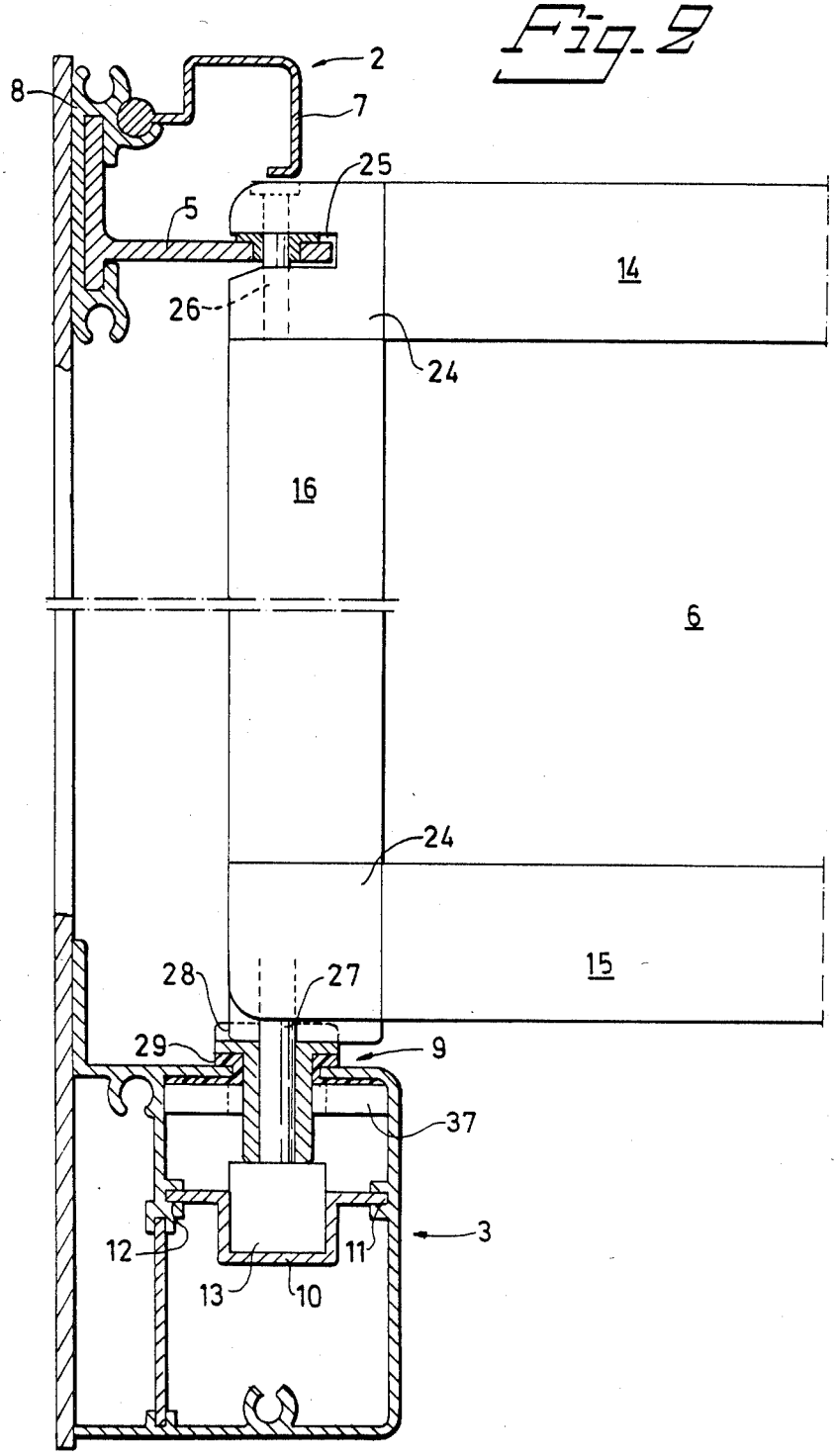
Figure 3:
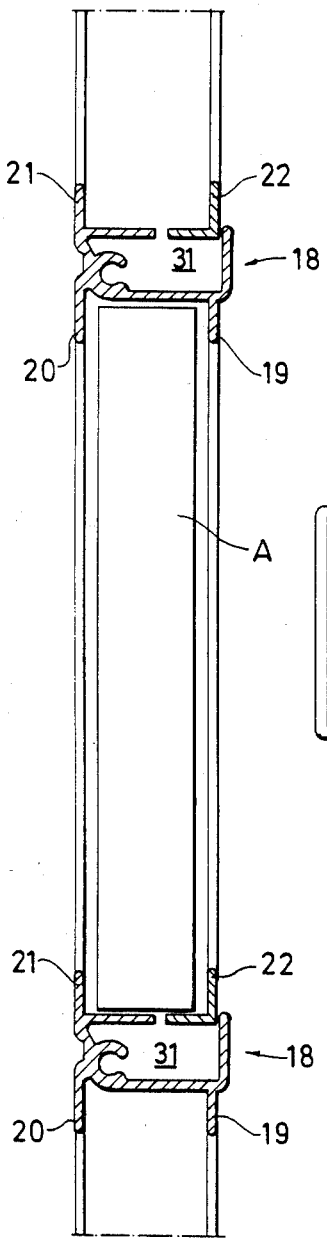
Figure 5:
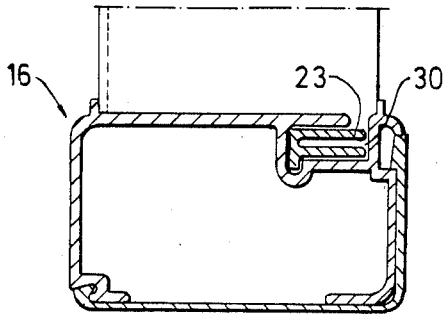
Figure 6:
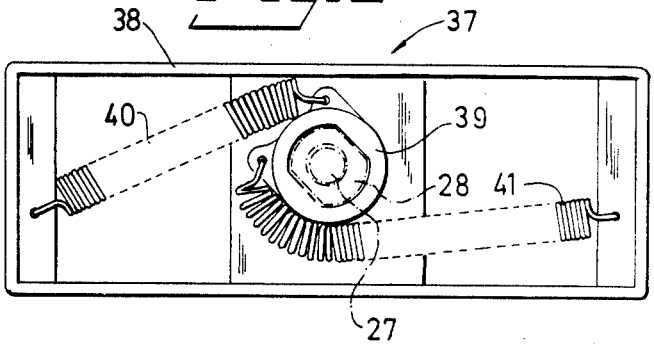
Figure 7:
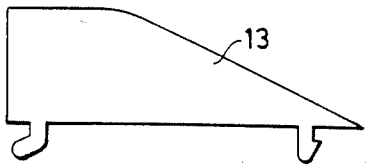

FIG. 1 illustrates an embodiment of the rack intended for mounting on a wall or the like, with the frames fitted into the wall mounting swung to the right in their initial displaying position, FIG. 2 is a sectional view through the wall mounting with a swingably adapted frame fitted to it, FIG. 3 is a cross section through a shelf space in the frames illustrated in FIGS. 1 and 2, FIG. 4 is a cross section of a bottom member in a frame, and from the figure will be seen the movement of a locking rail in the frame, FIG. 5 is a cross section through a side member of a shelf space in the frame, FIG. 6 is a plan view of a spring means for returning the frames to their initial position and FIG. 7 is a side view of a locking piece or stop for the bottom member of the wall mounting.

As will be seen from FIGS. 1 and 2, the wall mounting 1 comprises a top member 2 and a bottom member 3 connected by a vertical intermediate member 4. The top member 2 of the wall mounting 1 carries brackets 5, in which the respective frame 6 is suspendable, the top member 2 includes parts 7 and 8. Part 7 is hinged to part 8, which is intended to be fixed to a wall or the like, such that part 7 can be pivoted upwards to allow positioning of a frame 6, after which parts 7 and 8 are screwed together. By assembling the rails in this way the leafing frames 6 cannot be removed by unauthorized persons. There are journalling holes 9 on the bottom member 3 of the wall mounting 1, the bottom portions of the frames 6 being mounted with the aid of these holes. The holes 9 are associated with a two-way return spring means 37, illustrated in FIG. 6.

The bottom member 3 of the wall mounting 1 includes a locking unit, which locks all the leafing frames 6 and functions as follows. Inside the bottom member 3 of the wall mounting 1 there is a member 10 with a U-shaped cross section, the upper tips of which have outwardly projecting flanges respectively coacting with two grooves 11, 12 formed in member 3. The member 10 is displaced with the aid of a locking cylinder and key not shown on the drawing, and is provided with lockactuating means 13, one for each leafing frame 6. The means 13 are provided with a sloping surface, as is apparent from FIG. 7. In a locked condition the member 10 cannot be displaced, and when in the unlocked condition it is displaceable for moving the means 13 into, or out of, their displaceable locking position.

The leafing frames 6 comprise two horizontal members 14, 15 and two vertical side members 16, 17 having hollow sections. These hollow sections 14–17 are joined at the corners with special corner fittings 24. A plurality of shelves 18 is arranged between the two vertical side members 16, 17. As will be seen from FIG. 3, the shelves 15, 18 keep articles (A) in place by an inverted U-section at the upper edge including projections or flanges 19, 20 and two L-sections 21, 22 forming a U at the bottom edge. The L section 21 is rigidly mounted to the vertical side members 16, 17 while the other L-section 22 is connected at either end to two vertically running U-sections 23, glidably arranged in a special cavity 30 in the vertical side frame members 16, 17. Articles (A) are thus kept in place by means of the flanges 19, 20, 21, 22. The flange 21 is rigidly attached to the vertical side members 16, 17. The L section 22 is connected at both ends to a U-shaped member 23 (see FIG. 5), glidably mounted in a special cavity 30 in the vertical side frame members 16, 17. When the L sections 22 are completely lowered into the cavities 31 in the horizontal shelves 15, 18, an article A may easily be taken out from the shelf space of the leafing frames 6. The interconnected L-sections 22 and the U-members 23 are raised and lowered by a lever mechanism 32 (see FIG. 4) in a cavity of the member 15 in the frames 6, said mechanism mainly consisting of a locking profile 33 which is pivotable between two positions and extends internally in member 15. One edge 34 of the profile 33 is pivotably attached to the upper portion of the cavity via a hinge structure 35 such that the other free edge 36 is disposed for actuating the vertical movement of the U-members 23 in the member 16, and thereby the movement of the L-sections 22. When the locking profile 33 is in its upwardly swung position, to which it is biased with the aid of a spring, not illustrated on the drawing, the L-sections 22 are in their upper position in which the articles A cannot be removed from the shelf space of the frames 6.

The corner fittings 24 of the leafing frames 6 are fixable in the wall mounting 1 at the upper part of the frame 6 with the aid of a recess 25 in the outer part of the corner element 24, this recess accommodating the end of the bracket 5, to which it is lockable with the aid of a pin 26 through a hole in the bracket 5. At the bottom portion of the frame 6 the fitting 24 is lockable with the aid of a pin 27 at the bottom portion of said fitting 24. The pin 27 is mountable in a journal bushing 28 in the hole 9 of the lower member 3 of the wall mounting 1, said bushing 28 is provided with a slot. The pin 27 is actuated vertically by the means 13 on the member 10 which, as previously mentioned, is displaceable. When member 10 is displaced the pin 27 of the leafing frame 6 glides up or down on the sloping surface of the means 13. The pin 27 thus actuates the locking profile 33 inside the frames 6 and locks it in its upward position or releases it for enabling its downwardly pivotting opening movement. A handwheel or knob, not shown on the drawing, is placed at the lower outer corner of each frame 6 and is connected with the locking profile 33 such that the profile 33 is fixable in its upward locking position. The locking profile 33 is released, e.g. by turning the handwheel or pushing the knob, and can be pivoted downwards to its lower position in which the members 22 and 23 are moved to their end positions in which the articles A may be removed from the shelf spaces, providing that the locking unit of the wall mounting 1 has been unlocked and the pins 27 are in their lower positions. For locking the rack, the wheel is turned back or the knob reset so that the locking profile 33 swings upwards, thereby upwardly displacing the L sections 22 coacting with the members 23 (see FIG. 4).

The journalling bushings 28, in the bottom member 3 of the wall mounting 1 are taken through a plastics collar 29 and fits snugly therein. The portion of the bushing 28 projecting below the collar 29 and the upper portion of the bottom member 3 is furthermore adapted for coacting with the twoway functioning return spring means 37. This means 37 is designed such that it provides return bias when e.g. the bushing is turned clockwise in FIG. 6 and after release returns to its initial position. During leafing, when the bushing is turned anticlockwise the spring is again biased and returns to the initial position after turning pressure has ceased. The means 37 comprises, as will be seen from FIG. 6, of a frame portion 38 with a rotably mounted bushing 39 therein. One end of each of at least two helical springs 40, 41 are attached to the bushing 39, the other ends of these springs 40, 41 are attached to the frame portion 38 such that the bushing 39, through which the shaft of the bushing 28 and the pin 27 extend non-rotatably, is rotatable about 135° in both directions from its initial position.

I claim:

1. Arrangement in display and storage racks with swingable frames, particularly for easily stolen and difficulty displayed articles, a frame including at least one shelf space having a depth and a free height closely compatible with the extension in depth and height of an article (A) and defined laterally by two side members (16, 17) and vertically by a top member (14;18) and bottom member (15; 18), said defining members (14–18) having means (19–22) for preventing removal of the article (A) from the shelf space, characterized in that the means for preventing removal of the article (A) from the shelf space comprise projections (19–20) from the opposing surfaces of the top and bottom members extending in the area of the top and bottom portions of the article and a distance along the front and rear sides of the article, at least one (22) of said projections (19–22) is movable vertically from a position in which a portion, or the whole, of its length engages against the front or rear side of the article (A) and prevents its removal from the shelf space, and to a position in which substantially the whole of its length is away from the vertical extension of the article (A) such that the article (A) placed in the shelf space is removable therefrom by tipping out the top or bottom portion of said article (A); the side, top and bottom members (14–18) comprising hollow sections joined at their corner portions with corner fittings (24) in a manner known per se to form a frame (6), each top member (14;18) including the projections (19, 20), forming a U-shape with the opening downwards, and each bottom member (15;18) including two members (21, 22) of L-shaped cross section with one leg vertical, one of said L-shaped members (22) being vertically movable.

2. Arrangement as claimed in claim 1, characterized in that the vertically movable L-shaped member (22) has its end portions coacting with two vertically running sections (23) extending in a cavity (30) inside the vertical side members (16, 17), and in its opening position or retracted position said vertically movable L-shaped member is sunk inside a cavity (31) in the horizontal hollow section or bottom member (15;18).

3. Arrangement as claimed in claim 2, characterized in that the coacting members (22, 23) are raisable and lowerable vertically by the action of a lever mechanism (32) in the bottom member (15) and coacting corner fittings (24), said mechanism also including a pivotably disposed locking profile (33) which is spring-biased to a locking position in which the members (22, 23) are set in position preventing removal of the articles (A).

4. Arrangement as claimed in claim 3, characterized in that a plurality of top and bottom members (14, 15; 18) arranged in a frame (6) and together forming a plurality of shelf spaces are provided with a common actuating means on each frame (6) in the form of a handwheel or knob for actuating and locking the pivotable locking profile (33) in a desired position.

5. Arrangement as claimed in claim 4, characterized in that where a plurality of frames (6) are collected, each having a plurality of shelf spaces and being swingably attached to a wall mounting (1) or the like, each frame (6) has a top journalling pin (26) and a bottom journalling pin (27) for coaction with a journalling hole in the wall mounting (1), said bottom pin (27) being actuable vertically by a member (10), which is disposed longitudinally in the wall mounting (1) and provided with lock-actuating means (13), which in turn actuate the locking profile (33), whereby the pin (27) in its upper position is adapted to lock the pivotable locking profile (33) in its upwardly thrust position and thereby the vertically movable members (22) in their upper position, with the aid of the vertically running members (23) coacting with the members (22), for preventing removal of the items (A).

6. Arrangement as claimed in claim 5, characterized in that the bottom pin (27) is connected to a spring means (37) including a frame portion (38) with a therein rotatably mounted bushing (39) to which is fixed one end of at least two helical springs (40, 41), the other ends of said springs being attached to the frame portion (38) such that the bushing (39) with the shaft of the bushing (28) and the pin (27), non-rotatably mounted therein is pivotable about 135° in both directions from a neutral position or initial position.

* * * * *